United States Patent [19]

McMahon et al.

[11] 4,006,588

[45] Feb. 8, 1977

[54] WRIST WATCH

[76] Inventors: Robert J. McMahon, 1105 Brennan Drive, Warminster, Pa. 18976
Dolores A. Harmer, 1201 Easton Road, Warrington, Pa. 18976

[22] Filed: Nov. 19, 1975

[21] Appl. No.: 633,391

[52] U.S. Cl. ..... 58/126 R; 58/88 W; 58/127 R

[51] Int. Cl.² ..... G04B 19/00

[58] Field of Search ..... 58/126, 127, 88 W

[56] References Cited

UNITED STATES PATENTS

| | | | |
|---|---|---|---|
| 2,011,517 | 8/1935 | Geoffrion | 58/127 R |
| 2,451,250 | 10/1948 | Springer | 58/127 R |
| 3,548,733 | 12/1970 | Bueghner | 58/126 R |
| 3,608,214 | 9/1971 | Rancati | 58/127 R |
| 3,796,043 | 3/1974 | Ebdon | 58/120 R |

FOREIGN PATENTS OR APPLICATIONS

| | | | |
|---|---|---|---|
| 1,901,603 | 8/1970 | Germany | 58/127 R |
| 252,560 | 1/1948 | Switzerland | 58/127 R |

*Primary Examiner*—L. T. Hix
*Assistant Examiner*—Vit W. Miska
*Attorney, Agent, or Firm*—Zachary T. Wobensmith, II; Zachary T. Wobensmith, III

[57] ABSTRACT

A wrist watch is provided for indicating time. The watch has a case, with a transparent crystal covering a dial which has the hours indicated thereon by numerals and is also provided with variously colored zones between the numerals to designate the time by colors as well as by number.

A rotary dial is provided for indicating the hour with a cut out and a stamped arrow which permits color to be viewed for the designated hour with the arrow pointing to the numeral. A conventional minute hand is also provided.

2 Claims, 2 Drawing Figures

WRIST WATCH

BACKGROUND OF THE INVENTION

1. Field of the Invention

A wrist watch which in addition to indicating time numerically provides a color effect associated with the particular time being shown.

2. Description of the Prior Art

Learning to tell time by children is often a very difficult feat to master, particularly where the numerical relationship is not clear to the child. Color association with a particular time or time zone is more direct and less susceptible to misinterpretation by the child.

Watches have been provided with various designs on the dials to indicate changing of time with relation to various visual stimuli presented to the wearer but none of them are entirely satisfactory. The U.S. patent to Pakter et al., No. 3,763,648, shows a time piece for creating visual effects including combinations of hands, rotating dials and colors but no time color relation is illustrated. The U.S. Pat. to Lukens, No. 3,798,892, illustrates a clock mechanism in which the hour, minute and second hands are replaced by rotating multiple colored circles but no specific relationship to time and color zones is provided.

The watch of our invention provides colors for various time zones with the time numerically indicated which is not found in the prior art.

SUMMARY OF THE INVENTION

This invention relates to a watch wherein the dial has been divided up into zones with varying colors, a disc to replace the conventional hour hand with a small portion removed to permit color viewing and an arrow to indicate the time. A conventional rotatable minute hand is provided, with the disc and hand driven by conventional well known watch mechanism.

The principal object of the invention is to provide a watch wherein the time is displayed numerically and with a selected color.

A further object of the invention is to provide a watch which is simple and easy to use and attractive to children.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which.

Figure 1:
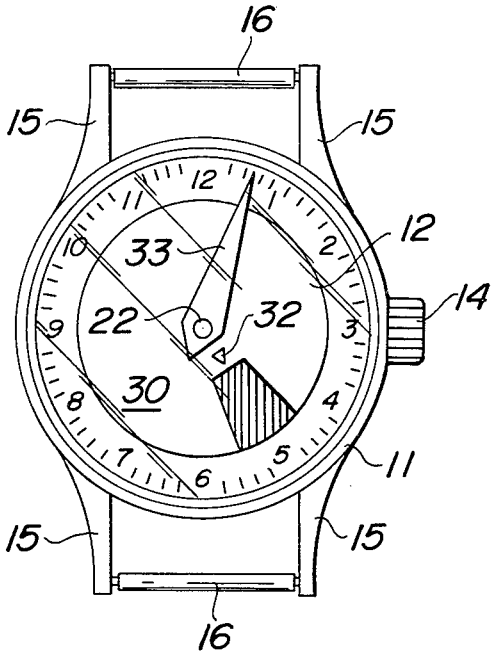
FIG. 1 is a top plan view of a watch embodying our invention.
Figure 2:
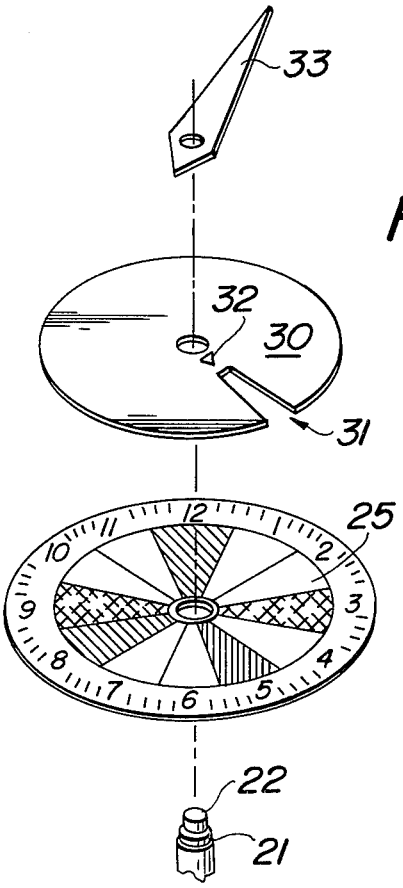
FIG. 2 is an exploded perspective view of portions of the watch of FIG. 1 which are related to the invention.

It should, of course, be understood that the description and drawings herein are illustrative merely and that various modifications and changes can be made in the structure disclosed without departing from the spirit of the invention.

Like numerals refer to like parts throughout the several views.

Description of the Preferred Embodiment OF THE PREFERRED EMBODIMENT

Referring now more particularly to the drawings, a wrist watch 10 is therein illustrated which includes an outer case 11, a transparent crystal 12, and a stem 14. The case 11 is provided with pairs of extensions 15 on opposite sides and with a pair of spring loaded pins 16 engaged therebetween to engage a band (not shown) to secure the watch to the wrist of a user (not shown).

A watch mechanism (not shown) of well known type is contained within the case 10 and has an outer hour output shaft 21 and an inner minute output shaft 22 extending therefrom in the center of the watch below the crystal 12. The watch 10 is also provided with a dial 25 of disc shape and has the numerals 1 to 12 around the perimeter thereof in conventional fashion. The dial 25, inwardly of the numerals, is divided into zones which as illustrated are green (G) for the portion between 11:30 and 12:30, white (W) for the portion 12:30 to 3:30, yellow (Y) for the portion 3:30 to 5:30 and red (R) for the portion 5:30 to 6:30. The selection of the particular colors for the particular time zones is arbitrary but in this illustration the color green (G) indicates to the child that it is time for lunch when the full green zone is illustrated. The white time period 12:30 to 3:30 refers to the period while the child is still in school. The yellow time portion 3:30 to 5:30 indicates that the child can play and the portion 5:30 to 6:30 being red the child knows that it is time to go home for dinner.

The hour output shaft 21 has a disc 30 detachably secured thereto which disc has a small generally guadrilateral shaped portion removed to provide an opening 31 which as described above would permit limited viewing of the various colored time zones as the disc rotates.

An arrow 32 is provided on disc 30 which points outwardly and to the numerals on dial 25 to indicate the hour as the disc rotates.

A minute hand 33 is provided, detachably secured to the minute output shaft 22 and which is rotated by the watch mechanism (not shown) to indicate the minutes of time as it is rotated.

It will thus be seen that apparatus has been provided with which the objects of the invention are attained.

We claim:

1. In a watch having an outer case, a transparent crystal, a watch mechanism with a rotary hour output shaft and rotary minute output shaft the improvement which includes a dial fixedly mounted within said case and provided with numerals for hour indication around the perimeter thereof, a plurality of differently colored time zones on said dial related to particular periods of time, minute indicating means driven by said minute output shaft, and hour indicating means driven by said hour output shaft, said hour indicating means comprising a rotatable disc in covering relation to said colored time zones on said dial and having an opening therethrough for sequential exposure of one of said time zones.

2. A watch as defined in claim 1 in which an arrow is provided on said disc which points to said hour numerals as said disc is rotated to indicate the time in hours.

* * * * *